US005931430A

United States Patent [19]

Palmer

[11] Patent Number: 5,931,430

[45] Date of Patent: Aug. 3, 1999

[54] MOTOR ASSEMBLY FOR CYLINDRICAL LOCKSET

[75] Inventor: Ralph P. Palmer, Indianapolis, Ind.

[73] Assignee: Best Lock Corporation, Indianapolis, Ind.

[21] Appl. No.: 08/636,545

[22] Filed: Apr. 25, 1996

[51] Int. Cl.[6] ..... E05B 9/08

[52] U.S. Cl. ..... 248/311.2; 70/449; 70/451; 248/300

[58] Field of Search ..... 248/674, 300, 248/309.1, 311.2; 70/377, 443, 449, 450, 451, 466, DIG. 37, DIG. 38, DIG. 39, DIG. 40, 271, 275, 277

[56] References Cited

U.S. PATENT DOCUMENTS

| | | | |
|---|---|---|---|
| 3,298,094 | 1/1967 | Russell et al. | 70/451 |
| 3,790,196 | 2/1974 | Sanders et al. . | |
| 3,854,763 | 12/1974 | Zawadzki et al. . | |
| 3,894,417 | 7/1975 | Taniyama . | |
| 3,955,387 | 5/1976 | Best et al. . | |
| 4,073,527 | 2/1978 | Schlage . | |
| 4,437,695 | 3/1984 | Foshee . | |
| 4,736,970 | 4/1988 | McGourty et al. . | |
| 5,018,375 | 5/1991 | Tully . | |
| 5,083,122 | 1/1992 | Clark . | |
| 5,421,178 | 6/1995 | Hamel et al. . | |
| 5,465,927 | 11/1995 | Chun-Jung | 248/674 |
| 5,474,348 | 12/1995 | Palmer et al. . | |

*Primary Examiner*—Michael Safavi
*Attorney, Agent, or Firm*—Barnes & Thornburg

[57] ABSTRACT

A motor-mount apparatus is provided for use with a motor-actuated cylindrical lockset that has a rotatable handle sleeve and a motor with a wire harness extending therefrom. The apparatus includes a motor housing adapted to lie within the rotatable handle sleeve and a plate having a support formed to include an inner surface, an opposite outer surface, an aperture extending therethrough, and a locking tab extending into the aperture. The locking tab lies in generally the same plane as the support and is coupled selectively to the motor housing to block sliding axial movement of the motor housing through the aperture and rotation of the motor housing relative to the support. In addition, the apparatus includes a wire-protection cap coupled to the plate. The cap is adapted to retain the wire harness on the outer surface of the support.

56 Claims, 3 Drawing Sheets

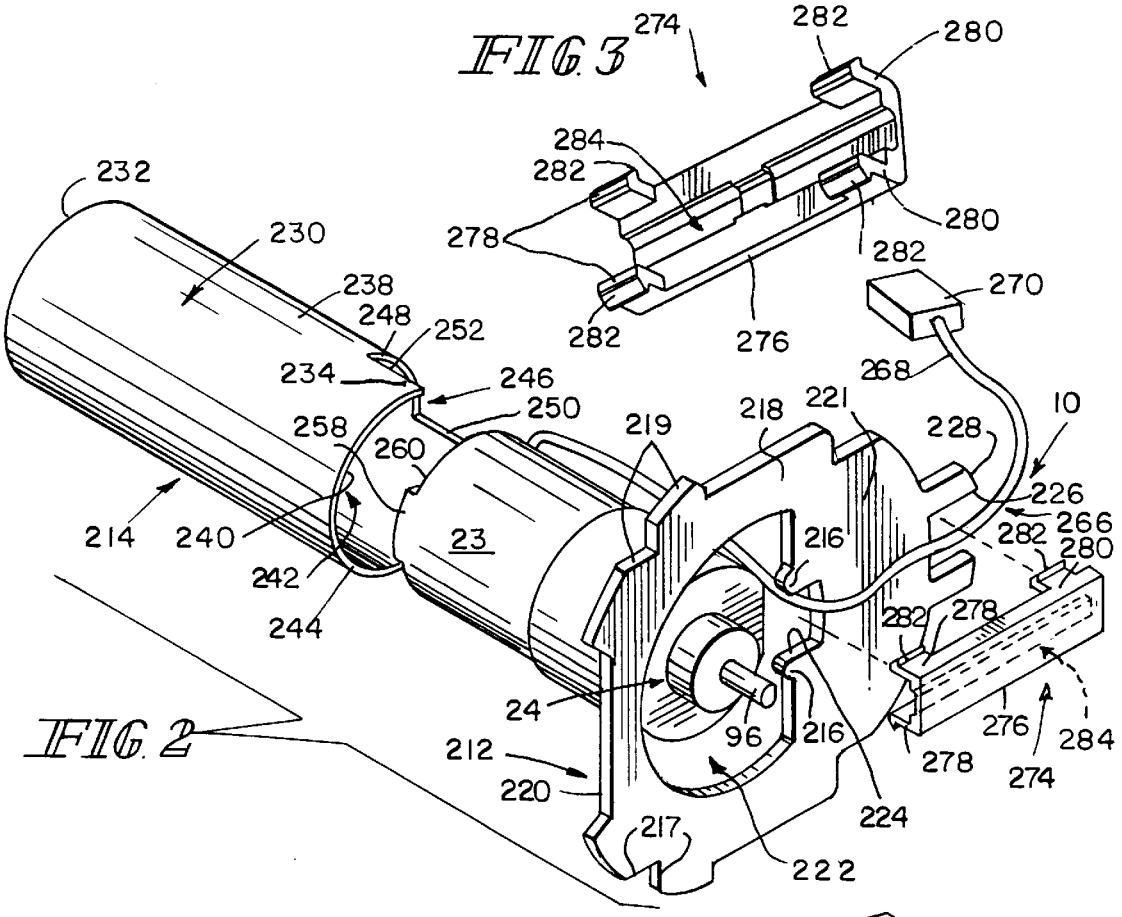
FIG. 3
274
282
280
284
282
278
280
282
276
282
270
232
230
238
248
252
234
246
250
258
260
214
240
242
244
23
219
218
221
228
10
226
266
282
280
216
282
278
24
96
216
276
284
212
220
217
224
222
278
274
FIG. 2
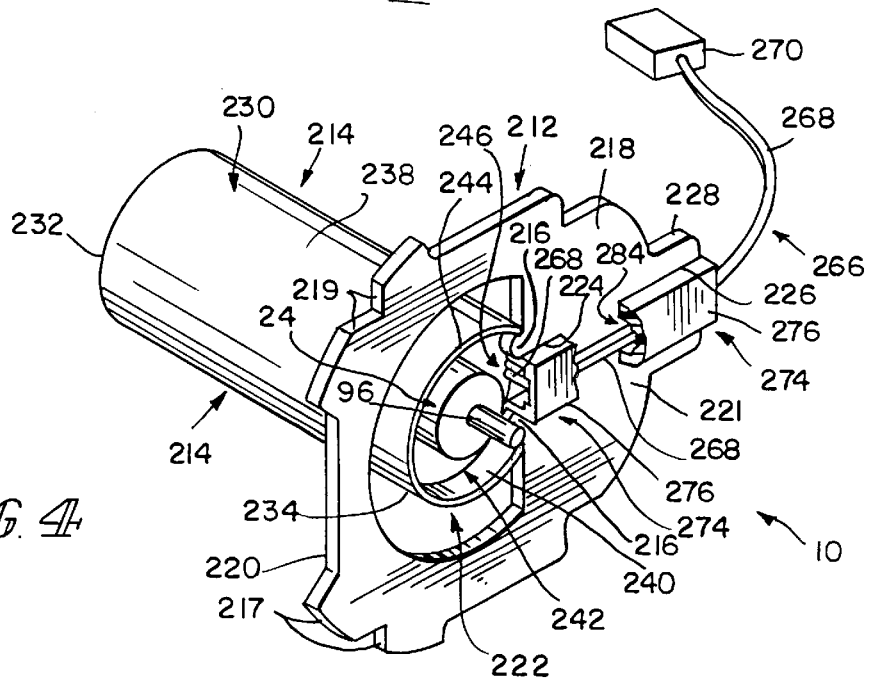
270
230
214
246
212
218
268
238
244
228
232
216
268
284
266
219
224
226
24
276
274
96
221
214
268
276
234
274
216
10
220
240
217
242
222
FIG. 4

MOTOR ASSEMBLY FOR CYLINDRICAL LOCKSET

BACKGROUND AND SUMMARY OF THE INVENTION

This invention relates to a mounting apparatus for a motor, and particularly to a mounting apparatus for a motorized lock actuator that electrically locks and unlocks a cylindrical lockset mounted in a door. More particularly, this invention relates to a mounting apparatus for an electromechanical lock actuator mechanism in a door-mounted cylindrical lockset having an outside door handle that can be locked against rotation.

Cylindrical locksets are well known and such a lockset is operated to lock and unlock a door by rotating inside and outside door knobs or lever handles connected to the lockset. Typically, a cylindrical lockset is used to connect a door handle to a retractable latch bolt. Each cylindrical lockset can include various mechanical linkages and locking mechanisms of the types described in the following paragraphs.

In use, a user can often rotate either the inside or outside door handle to operate the mechanical linkage mounted inside the lockset. This enables the user to retract a spring-biased latch bolt connected to the cylindrical lockset from a projected position extending outside the door and engaging a side slot formed in a doorjamb to a retracted position inside the door. The user is now free to swing the door on its hinges from a closed position to an opened position.

A locking mechanism of some kind is usually mounted in the cylindrical lockset. Such a locking mechanism is often actuated using a key or a button to lock or unlock the outside door handle. Typically, the locking mechanism is configured so that it can be actuated either by turning a key inserted into a keyway formed in the outside door handle or by turning or pushing a button mounted in the inside door handle. For example, cylindrical locksets using mechanical locking mechanisms are disclosed in U.S. Pat. Nos. 3,955,387 to Walter E. Best et al. and 4,437,695 to William R. Foshee. Each of these locksets include a spring-loaded mechanical locking bar and turn button. The turn button is mounted in the inside doorknob and is operable to allow a user to actuate the mechanical locking bar and thereby control locking and unlocking of the outside doorknob.

It is also known to use a miniature motor and locking linkage mounted inside a cylindrical lockset to control locking and unlocking of the outside doorknob or handle. See, for example, U.S. Pat. Nos. 5,083,122 to Keith S. Clark, 5,018,375 to Clay E. Tully, and 5,421,178 to Lyn E. Hamel et al. The '178 patent is assigned to the same assignee as the present invention and is incorporated herein by reference, for descriptions of electromechanical locking mechanisms.

It has been observed that motor-mounts designed to accept electrical motors for use in locking mechanisms are typically coupled within the lockset using additional fasteners. The use of multiple fasteners has been necessary to ensure that the motor-mount does not move or rotate within the lockset upon rotation of the inside door handle. However, it has been discovered that additional fasteners can make a lockset having a motor-actuated locking mechanism awkward to assemble and disassemble. A motor-mount made to hold an electrical motor in a fixed position within a lockset without using multiple fasteners would simplify assembly/disassembly of the motor-actuated locking mechanism, minimize necessary inventory for manufacture assembly and of the locking mechanism, and thus reduce the overall cost of the locking mechanism to the consumer.

It has been further observed that electrical locksets with a motor having a wire harness extending outwardly therefrom are often subject to accidental harness pull-out. In addition, the wire harness itself can often interfere with the surrounding moving or rotating lockset components. A motor-mount that provides a protected space for the wire harness and that minimizes accidental pull-out would be a welcome improvement over conventional mount apparatus.

According to the present invention, a motor-mount apparatus is provided for use in holding a motor housing within a motor-actuated cylindrical lockset. The motor-mount apparatus includes a substantially flat plate formed to include an aperture for receiving a motor-controlled lock actuator therethrough and locking tabs extending into the aperture to hold the motor housing in a fixed position within the lockset. Thus, the motor-mount apparatus is prevented from either rotating or sliding axially within a rotatable handle sleeve of the lockset.

In preferred embodiments of the present invention, the motor-mount apparatus includes a motor housing with an inner end, an opposite outer end having locking means thereon to engage the locking tab of the flat plate, and a cylindrical side wall extending between the opposite inner and outer ends. In addition, the motor housing preferably incorporates a bottom wall at its inner end that interlocks the motor thereto and prevents unwanted rotational movement of the motor within the cylindrical side wall of the housing. In addition, the cylindrical side wall of the motor housing includes an inner surface that defines a cavity sized for insertion of the motor therein and a locking flange that extends into the cavity to fasten the motor within the cylindrical side wall.

The inner surface of the cylindrical side wall is formed to include an internal wire channel therein. The wire channel extends between the opposite ends of the housing to accommodate the routing of a wire harness extending from the motor away from the motor-mount assembly. The routing of the wire harness through the protected space of the wire channel aids in eliminating eccentric alignment of the motor.

The wire harness of the motor is protected from wear by a wire-protection cap. This cap incorporates snap-in type legs which interlock into appropriate leg-receiving windows formed in the flat plate. Thus, the wire harness may be routed from the outer end of the housing, through the aperture of the flat plate, and up through the protective cap. The wire-protection cap itself includes a molded-in wire channel for routing the harness away from the motor-mount apparatus and outside of the lockset. In addition, a wire hold-down feature is preferably incorporated within the wire channel, thus providing a slight interference fit with the wire harness, thus reducing a potential accidental pull-out condition.

In an alternative embodiment of the present invention a motor housing is provided for use in conjunction with a lockset having a stationary hub with a slot therein and a rotatable handle sleeve positioned within the hub and formed to include a passageway therethrough. The alternative motor housing includes an outer end having a flexible locking tab thereon. This locking tab will interlock with the conventional hub slot to provide both rotational and axial resistance to movement of the motor-mount apparatus. It is understood that locksets often include flat side plates which abut the stationary hub. Thus, it is contemplated that the locking tab will also stop against a back surface of the flat side plate to prevent axial movement of the motor housing.

In a preferred embodiment, the locking tab incorporates a slotted feature therein. Thus, a wire harness extending outwardly from motor may be routed through the locking tab and away from the motor-mount apparatus. Preferably the locking tab is flexible so that it may deflect inwardly into cavity during assembly and then snap or deflect upward into the hub slot in the assembled position. This flexibility aids in assembly of the motor-mount apparatus into the existing lockset.

The motor-mount apparatus of the present invention supports a motor therein and is easily mounted in certain conventional cylindrical locksets to permit a lockset to be converted from a fully mechanical lock actuator to a motorized lock actuator in the field or in the shop. In addition, development of the motor-mount apparatus was undertaken to reduce cost of locksets to the customer; simplify design for better ease of assembly/disassembly; reduce overall components to minimize inventory; prevent potential rotational friction between the motor-mount and a handle sleeve; provide better bearing surface between applicable components over a conventional lockset; supply additional wire protection; provide additional assembly flexibility; and incorporate a wire hold-down feature to help minimize potential wire pull-out.

Importantly, the motor-mount apparatus in accordance with the present invention creates a multifunctional part which reduces inventory and overall part/assembly costs. The motor-mount apparatus is much easier and quicker to assembly than conventional motor-mount assemblies, lending more flexibility to both the assembly line and the external customer. Because the motor-mount apparatus does not use small screws, assembly efforts are simplified and there is no fear of these screws loosening over time. In addition, the motor-mount apparatus is "field friendly" in regards to disassembly/reassembly if so needed such as repair and or retrofit situations.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 2 is an exploded assembly view of the motor-mount apparatus of FIG. 1 showing a sleeve-like motor housing that includes a notch having a bottom edge and opposite side edges formed in its side wall, a motor having both a wire harness and a lock actuator, a plate having an aperture sized for extension of the lock actuator therethrough and locking tabs extending into the aperture for engagement with the side edges of the notch to prevent rotation of the motor housing and the bottom edge of the notch to prevent axial movement of the housing, and a wire-protection cap formed for extension over the wire harness and engagement with the plate;

FIG. 3 is perspective view of the wire-protection cap of FIG. 2 showing a body portion, a pair of snap-in type legs formed to interlock on the plate, and a wire channel extending through the body and between the legs;

FIG. 4 is an assembled view of motor-mount apparatus of FIG. 2, with a portion broken away, showing the locking tabs of the plate positioned securely within the notch of the tubular motor housing, the wire-protection cap mounted on the plate, and the wire harness extending through the wire channel of the wire-protection cap for extension away from the motor-mount apparatus;

DETAILED DESCRIPTION OF THE DRAWINGS

Figure 1:
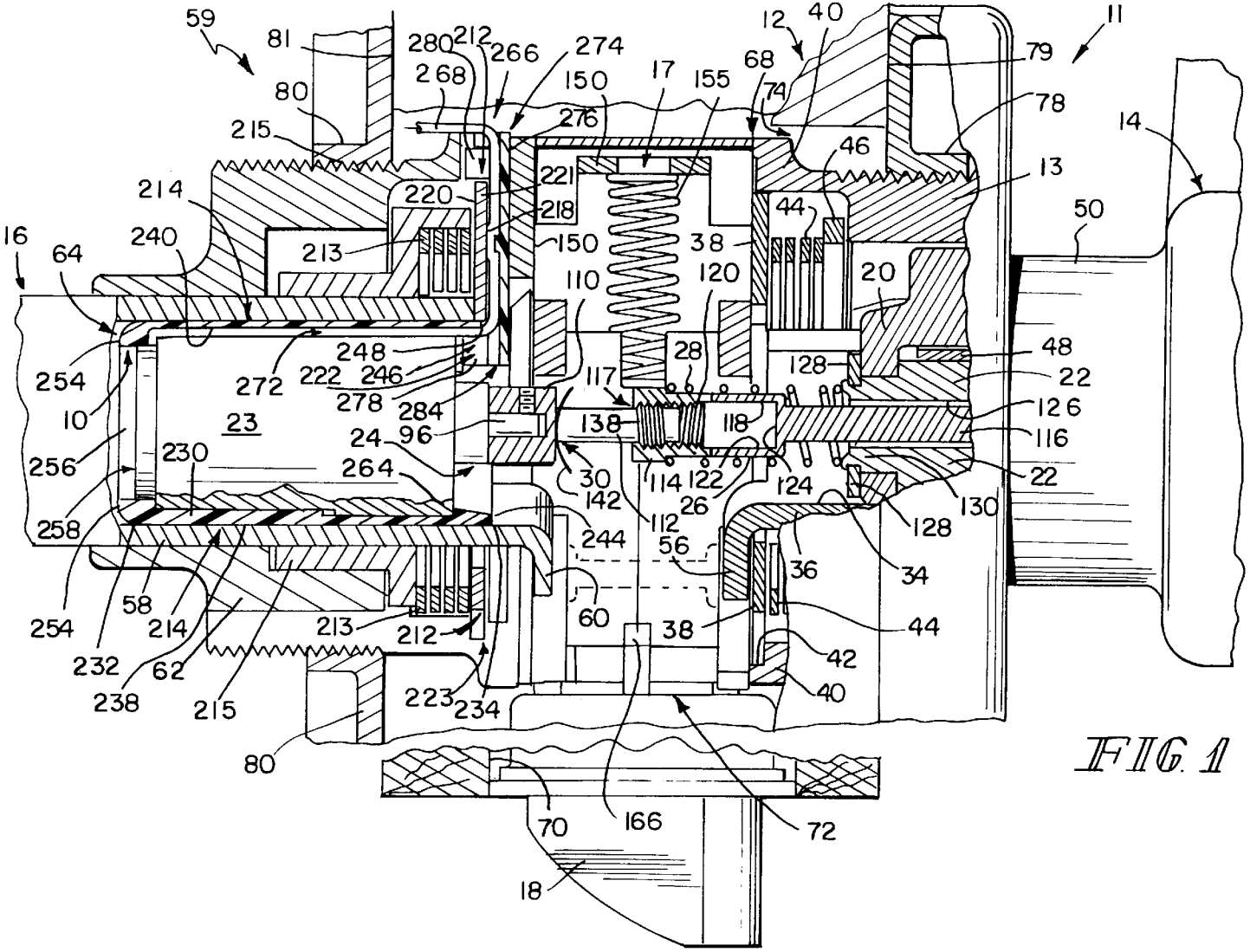
FIG. 1 is a partial longitudinal section through a cylindrical lockset containing a motor and a motor-mount apparatus in accordance with the present invention, the motor-mount apparatus being positioned inside a rotatable handle sleeve in the lockset, the motor-mount apparatus including a tubular motor housing positioned to lie within the handle sleeve, a flat plate appended to one end of the motor housing, and a wire-protection cap mounted on the plate and configured to receive a motor wire harness therein.
Figure 5:
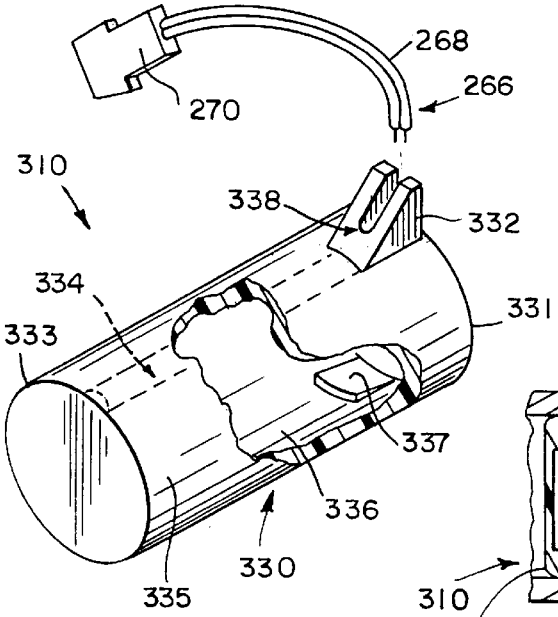
FIG. 5 is a perspective view of an alternative embodiment of a motor-mount apparatus in accordance with the present invention, with a portion broken away, showing a mounting flange positioned in an interior region at an outer end of the motor housing and gripping tab extending outwardly from the cylindrical sleeve-like motor housing.
Figure 6:
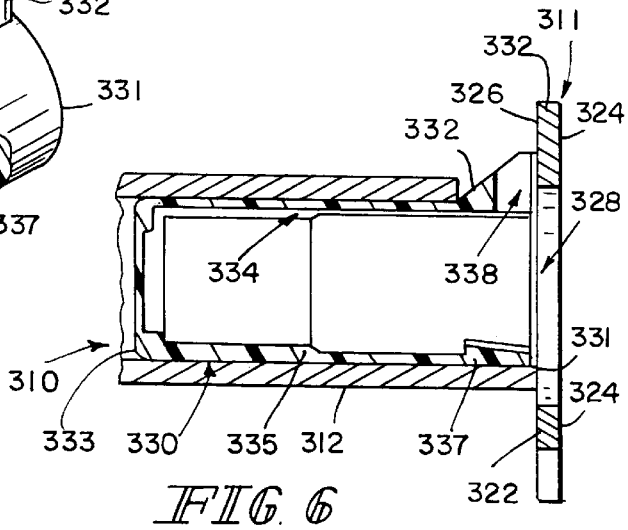
FIG. 6 is a cross-sectional view of the motor-mount apparatus of FIG. 5 positioned inside a rotatable handle sleeve and showing the motor-mount apparatus stopped against a side plate in the cylindrical lockset.

A motor-mount apparatus 10 in accordance with the present invention is formed to be housed within a motor-actuated cylindrical lockset 11 positioned in a door 12 as shown in FIG. 1. Cylindrical lockset 11 is operable by means of either an outside door handle/knob 14 or an inside door handle/knob 16 to retract a retractor assembly 17 including spring-biased latch bolt 18. The lockset 11 includes a locking lug 20 mounted on a reciprocal locking lug bushing 22 with a locking cam 48 therebetween, a motor 23 situated within the motor-mount apparatus 10, and a motor-controlled lock actuator 24 for moving the reciprocal bushing 22 and locking lug 20 between an outside door handle-locking position shown in FIG. 1 and an inside door handle locking position (not shown).

Illustratively, the motor 23 is secured within the apparatus and is coupled to the motor-controlled lock actuator 24. The motor-controlled lock actuator 24 includes a plunger 26, a plunger shaft spring 28 coupled to the plunger 26 and the bushing 22, and a rotatable motor shaft spindle 30 for reciprocating the plunger 26 to cause the reciprocal bushing 22 and locking lug 20 to move back and forth between its locking and unlocking positions. For additional description of the movement of the plunger 26, see U.S. Pat. No. 5,421,178, which has been incorporated herein by reference. The motor-mount apparatus 10 prevents the motor 23 from undergoing rotational and axial movement within the lockset 11 without additional attachment components while lending increased flexibility to an assembly line and to a customer.

As shown in FIG. 1, locking lug bushing 22 is mounted for back and forth sliding movement in a central passageway 34 formed in a key-actuated roll-back sleeve 36. This sleeve 36 includes a conventional pie-shaped, radially outwardly projecting, key-release cam 56. Rotation of the key-actuated roll-back sleeve 36 will cause its cam 56 to roll back the retractor assembly 17 shown in FIG. 1 to retract the spring-biased latch bolt 18 into the door 12.

Illustratively, a thrust plate 38 is securely fastened within the lockset 11 between a side hub 40 and the retractor assembly 17. Preferably, rotation of plate 38 is blocked by anchoring tabs (not shown) which are securely fastened within notches 42 (FIG. 1) formed in the side hub 40 of lockset 11. Typically the plate 38 is constructed from cold-rolled steel, however, it may be constructed from a wide variety of materials typically used within a lockset 11. In addition, a lever-return spring 44 is mounted between the thrust plate 38 and a keyed spring-drive plate 46.

As is the custom, the key-actuated roll-back sleeve 36 is mounted for rotation. The outside door handle 14 includes a cylindrical neck 50. As also shown in FIG. 1, the radially outwardly projecting key-release cam 56 is formed to normally lie on the key-actuated roll-back sleeve 36. It will be understood that a user can rotate the outside door handle 14 to rotate the key-release cam 56 and roll back the retractor assembly 17 shown in FIG. 1 to retract the spring-biased latch bolt 18 into the door 12. Thus, latch bolt 18 can be rolled back either by turning a key (not shown) to rotate the key-actuated roll-back sleeve 36 or by turning the outside door handle 14.

As shown in FIG. 1, another cylindrical inside handle sleeve 58 is provided on an inside handle side 59 of lockset 11 and is formed to include an arcuate, radially outwardly projecting roll-back cam 60 that is coupled to the retractor assembly 17. The inside handle sleeve 58 is mounted for rotation inside a cylindrical fixed hub 62 and is formed to include an elongated central passageway 64. Illustratively, the inside door handle 16 is mounted on inside handle sleeve 58 and held in place in the usual way so that rotation of the inside door handle 16 by a user will cause inside handle sleeve 58 and its roll-back cam 60 to roll back the retractor assembly 17 to retract the spring-biased latch bolt 18.

Illustratively, motor-mount apparatus 10 includes a plate 212 coupled to a motor housing 214. The plate 212 is preferably situated within the lockset 11 between the retractor assembly 17 and the inside handle sleeve 58. The plate 212 includes lockset anchoring means for coupling the plate 212 within the lockset 11 and for blocking movement therein. Moreover, a lever-return spring 213 is mounted between the plate 212 and a non-keyed spring-drive collar 215. Preferably, rotation of plate 212 is blocked by two sets of anchoring tabs 217,219 which are securely fastened within notches 223 (FIG. 1) formed in the stationary hub 62 of lockset 11. Typically the plate 212 is constructed from cold-rolled steel, however, it may be constructed from a wide variety of materials typically used within a lockset 11.

The plate 212 is positioned within the lockset 11 so that its outer surface 218 faces toward the retractor assembly 17 and an opposite inner surface 220 faces toward the inside door handle 16. In addition, as best shown in FIG. 2, the plate includes a support 221, an aperture 222 extends between the outer and inner surfaces 218, 220 of plate 212 and is normally sized to receive roll-back cam 60 of the inside handle sleeve 58, the motor-controlled lock actuator 24, and a portion of the motor housing 214 therethrough.

In order to grip the motor housing 214, the plate 212 includes a pair of locking tabs 216 which extend into the aperture 222 and are positioned in substantially the same plane as the support 221. In addition, will be discussed in greater detail below, the locking tabs 216 engage the motor housing 214 and block both axial movement of the housing 214 into the retractor assembly 17 and rotational movement of said housing 214. Advantageously, the positioning of the locking tabs 216 within the aperture 222 to grip the motor housing 214 enable manufacturers to eliminate cumbersome multi-part gripping assemblies. As will be explained later in this application, the plate 212 is formed to include spaced-apart, leg-receiving windows 224, 226 extending therethrough. One window 224 is illustratively positioned to lie between the locking tabs 216 while the other window 226 is positioned to lie in and extend through a lockset exit tab 228.

The motor housing 214 is typically constructed from a plastics material and includes a cylindrical side wall 230 and opposite inner and outer end portions 232, 234. Side wall 230 is generally linear in shape for extension into the elongated central passageway 64 formed within the inside handle sleeve 58, as shown in FIG. 1. However, it is contemplated that the side wall 230 may take a variety of forms so long as it sized for insertion into inside handle sleeve 58. Illustratively, cylindrical side wall 230 of motor housing 214 includes an outer wall 238 which engages the inside handle sleeve 58 and an opposite inner wall 240 that defines a longitudinally extending cavity or passageway 242 configured to receive the motor 23 as shown in FIG. 1. Additionally, outer end portion 234 includes a mouth 244 formed thereon which extends about the circumference of the cavity 242 and engages the locking tabs 216 to prevent movement of the mouth 244 relative to the inside handle sleeve 58.

Illustratively, motor housing 214 of the mounting apparatus in accordance with the present invention is designed to be fastened securely between the plate 212 and the inside door handle 16 within the elongated central passageway 64 of the rotating inside handle sleeve 58. The mouth 244 of housing 214 preferably includes a locking notch 246 therein. This locking notch 246 is defined by a bottom edge 248 and opposite side edges 250, 252. As best shown in FIG. 4, the bottom edge 248 of the notch 246 rests against the locking tabs 216 to prevent axial movement of the housing 214 within the lockset 11. In addition, the locking tabs 216 extend through the locking notch 246 between the side edges 250, 252, thus preventing rotational movement of the motor housing 214 within the lockset 11.

Motor housing 214 of motor-mount apparatus 10 is preferably constructed of a self-lubricating type plastic material such as celcon™ or delrin™ which are commonly available commercial plastics. Thus, the motor housing 214 reduces rotational friction forces between the outer wall 238 of the housing 214 and the rotating handle sleeve 58. However, it is understood that the motor housing 214 may be constructed from a wide variety of materials commonly used to construct mounting sleeves.

In preferred embodiments of the present invention, the motor housing 214 itself prevents movement of the motor 23 within the lockset 11. Referring to FIG. 1, the inner end portion 232 of motor housing 214 is formed to include a bottom wall 254 having a notch 256 therein for accepting a corresponding boss 258 on a bottom surface 260 of the motor 23. Preferably, the notch 256 is defined by rim 262 which is shaped in order to interlock the motor 23 within the cavity 242, thus preventing unwanted rotational movement of the motor 23 relative to the sleeve 58.

In addition to preventing rotational movement of the motor 23 within lockset 11, the motor housing 214 is preferably designed to prevent axial movement of the motor 23 through outer end portion 234 toward the retractor assembly 17. To prevent this axial movement, the cylindrical side wall 230 includes a mounting flange 264 extending about the circumference of the inner wall 240 as shown in FIG. 1. The mounting flange 264 is tapered to allow the motor 23 to snap in place within the cavity 242 during assembly. It is contemplated that the number and relative positioning, as well as the size of the mounting flange 264, may be varied so long as the motor 23 is securely mounted within the sleeve-like housing 214.

Referring again to FIG. 2, motor 23 includes a wire harness 266 having at least one wire(s) 268 and a connector 270 to prevent the wire 268 from causing eccentric alignment of the motor 23. As shown in FIG. 1, the inner wall 240 of the cylindrical side wall 230 is preferably formed to include an internal wire channel 272 therein. As shown in FIG. 1, the channel 272 preferably extends between the bottom wall 254 and the mouth 244. Upon assembly of the motor 23 within the housing 214, the wire harness 266 extends from the internal wire channel 272 and through the mouth 244 of the housing 214. As show in FIGS. 2 and 4, a lockset 11 incorporating the plate 212 of apparatus 10 therein, preferably routes the wire harness 266 through the aperture 222 of said plate 212. The wire(s) 268 then rests upon the outer surface 218 of the plate 212.

In a preferred embodiment of the present invention, motor-mount apparatus 10 further includes a wire harness retainer or wire-protection cap 274 to protect and retain the wire(s) 268 on the plate 212. As best shown in FIG. 3, the cap 274 is formed to include a body portion 276 and pairs of snap-in type legs 278, 280 which interlock into the appropriate leg-receiving windows 224, 226 on the plate 212. Each leg 278, 280 includes a flexible tab 282 thereon that engages the inner surface 220 of the plate 212.

Additionally, the body portion 276 of the wire-protection cap 274 has a wire passage 284 formed therein to allow the wire(s) 268 of the wire harness 266 to be routed outside the lockset 11 while being fully protected and shielded by the body 276 from the moving components of the retractor assembly 17. The wire passage 284 is formed within the body 276 such that the body portion 276 provides a slight interference fit with the wire harness 266 to discourage any accidental pull-out problem during installation on door 12. While the cap 274 is preferably constructed of the same plastics material as the motor housing 214, it is understood that the cap 274 may be constructed from a wide variety of materials capable of affixing the wire harness 266 on the plate 212.

Figure 7:
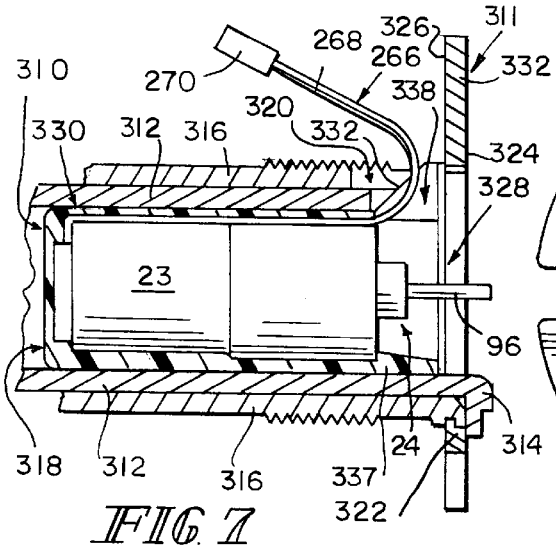
FIG. 7 is a cross-sectional view of the motor-mount apparatus of FIG. 6 positioned inside a rotatable handle sleeve mounted in a stationary hub and showing the apparatus containing a motor and having a gripping tab extending through a slot formed in the stationary hub and stopped against the side plate.

An alternative embodiment of the motor-mount apparatus in accordance with the present invention is illustrated in FIGS. 5–8. Motor-mount apparatus 310 is designed to be used in a lockset 311 having a cylindrical inside handle sleeve 312 formed to include an accurate, radially outwardly projecting roll-back cam 314. The inside sleeve 312 is mounted for rotation inside a cylindrical fixed hub 316 as shown in FIG. 7 and is formed to include an elongated central passageway 318 sized for receiving the motor 23 therein. The hub 316 includes a slot 320 formed therein. In addition, the lockset 311 includes a side plate 322 that guides rotational movement of the roll-back cam 314 thereon. The side plate 322 includes a front surface 324, an opposite back surface 326, and an aperture 328 extending between the front and back surfaces 324,326. Additionally, mounting apertures 327 extend therethrough to enable the side plate 322 to be fastened securely within the lockset 311. The apertures are sized to locate and retain plate 312.

Figure 8:
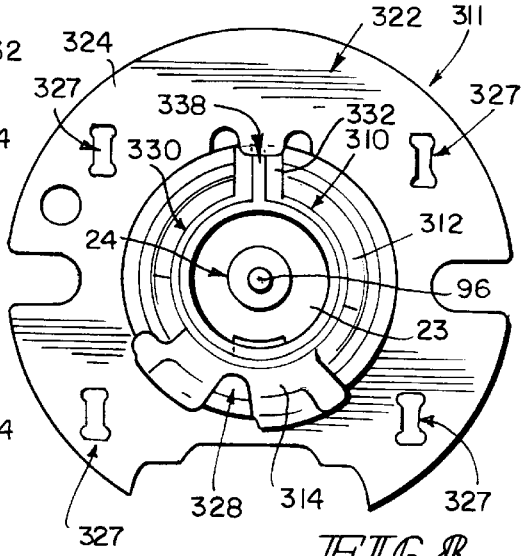
FIG. 8 is an end view of the motor-mount of FIG. 7 showing the side plate having an aperture through which the motor extends and a stopping tab extending into the aperture for engagement with the gripping tab.

Illustratively, motor-mount apparatus 310 includes a motor housing 330 including an outer end 331, an opposite inner end 333, and a cylindrical side wall 335 extending between the opposite ends 331, 333. Housing 330 is constructed similarly to the motor housing 214 of FIGS. 1–4, except that housing 330 includes a flexible gripping tab 332 rather than the locking notch 246 at the outer end 331 of the housing 330. The motor housing 330 is held in a stationary position within the central passageway 318 of the rotating inside handle sleeve 312 due to the interaction between the tab 332 and both the fixed hub 316 and the back surface 326 of the side plate 322. The flexible tab 332 is typically constructed of a plastics material and deflects inwardly during assembly of the motor housing 330 into the cylindrical inside handle sleeve 312 and then snaps or deflects through the slot 320 formed in the fixed hub 316 in the assembled position as shown in FIGS. 7 and 8.

This flexible gripping tab 332 will interlock with the hub 316 and side plate 322 to prevent both rotational and axial resistance to movement of the motor housing 330. Gripping tab 332 extends through the preformed mounting slot 320 to interlock with the hub 316 and to provide both rotational and axial resistance to movement of the motor housing 330. In addition, as shown in FIG. 7, the gripping tab 332 stops against the back surface 326 of the side plate 322 to create an interference fit and thus prevent axial movement of the apparatus 310 into the retractor assembly 17.

Moreover, the apparatus 310 is sized for insertion of the motor 23 therein. Typically the motor 23 includes a wire harness 266 extending outwardly therefrom. The housing 330 of apparatus 310 is similar to motor housing 214 illustrated in FIGS. 1–4, in that a wire passageway 334 extends along an inner wall 336 to route the wire 268 of the wire harness 266 through the motor housing 330 for extension away from the lockset 311. Further, a tapered mounting flange 337 extends from the inner wall 336 for engagement with the motor 23.

To further aid in routing the wire 268 away from the lockset 311. The housing 330 incorporates a slot 338 extending through the tab 332. As shown in FIG. 7, the wire(s) 268 of the wire harness 266 extends through the wire passageway 334 and through the slot 338. Referring now to FIG. 8, the wire(s) 268 is prevented from interfering with moving components of the retractor assembly 17 by remaining adjacent the back surface 326 of the side plate 322 not passing through the aperture 328.

Once incorporated into the lockset 11, the motor-mount apparatus in accordance with the present invention extends into the door 12. Door 12 is prepared in the customary way to include a central cavity 68 containing the latch-retractor assembly 17, an end bore 70 receiving a latch tube 72 containing the spring-biased latch bolt 18, a first side bore 74, an opposite second side bore (not shown) receiving the inside fixed hub 62, and motor-mount apparatus 10. An outside rose liner 78 is mounted on exterior surface 79 of door 12 to receive outside fixed hub 13 and hold it in place. Also, an inside rose liner 80 is mounted on an interior surface 81 of door 12 and is threaded to receive inside fixed hub 62 and hold it in place in the second side bore (not shown).

Illustratively, the motor 23, being securely fastened in motor housing 214, extends through the aperture 222 in the plate 212 and into the central cavity 68 formed in the door 12 as shown in FIG. 1. Preferably, motor 23 is selected in order to consume as little power as possible. Illustratively, a miniature DC motor 23 is used of the type that can be run by a low-voltage DC battery power such as a six volt battery. Such a motor 23 consumes relatively low power as compared to a conventional electric solenoid. Illustratively, motor 23 includes a drive shaft 96 which can be rotated in either a clockwise or counterclockwise direction to mate with and turn the spindle 30. Preferably, motor 23 is programmed to rotate drive shaft 96 until only shortly after the movement of the plunger 26 is complete.

Motor shaft spindle 30 includes a socket 110 and a cylindrical post 112. Socket 110 is configured to mate with and turn with an outer end of motor drive shaft 96. Illustratively, a setscrew is used to anchor socket 110 on motor drive shaft 96. Post 112 has one end appended to socket 110 and another end formed to include a plurality of external threads 138. Motor shaft spindle 30 functions to convert rotational movement of the motor drive shaft 96 into reciprocating axial movement of plunger 26 so that motor 23 can be used to move the locking lug 20 on bushing 22 back and forth between the outside door handle-locking position shown in FIG. 1 and the outside door handle unlocking position. A further description of the components used in movement of the locking lug 20 is provided in U.S. Pat. No. 5,421,178, which has been incorporated herein by reference.

Plunger 26 includes a connector portion 114 at one end and a slider portion 116 extending towards the other end as shown in FIG. 1. Connector portion 114 is formed to include a blind hole 117 that is sized to receive the threaded end 138 of post 112. An interior side wall 118 defining blind hole 117 includes a plurality of internal threads designed to mate with the external threads 138 formed on post 112. Threads in blind hole 117 define a threaded section 120 situated in an axially outer portion of interior side wall 118 near the open mouth of blind hole 117. As shown in FIG. 1, the interior side wall 118 also includes an unthreaded section 122 located deeper in the blind hole 117 between threaded section 120 and a bottom wall 124 of the blind hole 117. This unthreaded section 122 operates to receive the threaded end 138 of post 112 during a certain stage of operation to allow motor shaft spindle 30 to rotate inside blind hole 117 without converting rotation of the motor shaft spindle 30 into axial movement of the plunger 26.

Motor shaft spindle 30 and plunger 26 can be made out of a variety of materials including brass, steel, and zinc. Plunger 26 could also be made out of plastics material including a threaded insert made out of the same material as motor shaft spindle 30 and configured to define the threaded section 120 inside blind hole 117 of plunger 26. The parts 26, 30 can also be made using powdered-metal processes.

Locking lug bushing 22 is formed to include a longitudinally extending aperture 126 sized to receive the slider portion 116 of plunger 26. Slider portion 116 includes a spline that mates with aperture 126 to prevent rotation of slider portion 116 in aperture 126 as plunger 26 reciprocates during operation of the motor-controlled lock actuator 24. A washer 128 is mounted on the inner end of bushing 22 to hold locking lug 20 in place. An annular spring mount 130 projects through the central aperture formed in washer 128 as shown in FIG. 1.

Plunger shaft spring 28 is a coiled compression spring that functions to transfer force from the plunger 26 to the bushing 22 so that the bushing 22 slides in the passageway formed in the key-actuated roll-back sleeve 36 to move the locking lug 20 to its outside door handle-locking position shown in FIG. 1 in response to axial movement of plunger 26 toward the outside door handle 14. Plunger shaft spring 28 includes a first end abutting an external shoulder formed on the connector portion 114 of plunger 26 and a second end abutting the annular spring mount 130 formed on the locking lug bushing 22. Illustratively, the plunger shaft spring 28 is an elongated coiled spring that winds around the exterior surface of plunger 26 as shown in FIG. 1.

As shown in FIG. 1, retractor assembly 17 includes a retractor frame 150, retractor (not shown) positioned within the frame 150, and two bottom retractor springs 155 for yieldably urging the retractor and thus the latch bolt 18 to the latch-projecting position. The retractor grips and pulls tailpiece 166 during operation of retractor assembly 17 to retract latch bolt 18 into door 12. The tailpiece 166 is connected to the latch bolt 18 in the conventional way and extends through a slot formed in a back plate 168 that is coupled to the retractor frame 150 to lie between the retractor (not shown) and the inner end of the latch tube 72. A further description of components positioned within the retractor frame 150 to connect door handles 14, 16 to retractor assembly 17 are described in U.S. patent application Ser. No. 08/005,625, relevant portions of which have been incorporated herein by reference.

In use, as the motor shaft spindle 30 is rotated by motor 23 secured in motor housing 214, the external threads 138 on cylindrical post 112 of spindle 30 move in the blind hole 117 formed in plunger 26 to engage and disengage the threads in threaded section 120. Illustratively, the spindle 30 includes approximately four threads 138, as shown best in FIG. 1, with clearance machined behind the threads 138 to allow rotation of the spindle 30 without additional linear movement of the plunger 26. Plunger 26 moves linearly as the threaded portion 138 of spindle 30 engages the threaded section 120 and rotates inside the blind hole 117 formed in the connector portion 114 of plunger 26. The blind hole 117 is formed to include only the necessary number of threads in threaded section 120 to yield the required linear movement of plunger 26. Thus, during operation of the motor 23 to rotate drive shaft 96, the spindle 30 rotates to advance the plunger 26 in a selected direction.

In the illustrated embodiment, to lock the outside handle 14 against rotation, plunger 26 is moved away from motor 23 to push plunger shaft spring 28 against bushing 22 and thereby move bushing 22 about 0.250 inch (0.63 cm) to carry the locking lug 20 mounted on bushing 22 to its outside door handle-locking position shown in FIG. 1.

The outside door handle 14 is unlocked automatically in the following manner. When a user causes the motor 23 to reverse the direction of rotation of drive shaft 96, spindle 30 rotates to pull plunger 26 toward the motor 23 (by virtue of the threaded connection between spindle 30 and plunger 26), thus allowing the bushing 22 to move in the passageway formed in key-actuated roll-back sleeve 36. Such movement of bushing 22 functions to move the locking lug 20 (FIG. 1) in the unlocked position. In the unlocked position, locking lug 20 has been moved to permit rotation of handle 14. Accordingly, by using motor-controlled lock actuator 24, a user can automatically move locking lug 20 to unlock the outside door handle 14, thereby allowing the user to turn the outside door handle 14 causing its key-release cam 56 to roll back the retractor assembly 17 to retract the spring-biased latch bolt 18 into the end bore 70 formed in door 12.

A wavy washer 142 or similar spring 28 member is provided to ensure that threads 138 on spindle 30 always re-engage the threads 120 on plunger 26 at the proper time (i.e., when the locking lug 20 is in the unlocked position). As shown in FIG. 1, the wavy washer 142 is mounted on post 112 to act against socket 110 and connector portion 114 when the locking lug 20 is arranged to lie in its outside door handle-unlocking position.

Spindle 30 and plunger 26 are designed in such a way that spindle 30 becomes self-disengaged from plunger 26 after causing the desired linear movement of plunger 26 in either direction. Both spindle 30 and plunger 26 have only the number of threads necessary for the required linear movement. Advantageously, this allows actuator 24 to be less sensitive to variations in the on/off timing of motor 23 and eliminates the possibility of the motor 23 stalling due to overdriving the bushing 22 and locking lug 20 subassembly in either the locked or unlocked position.

Plunger 26 is not directly secured to bushing 22 (which carries locking lug 20). However, the linear movement of plunger 26 (to lock outside door handle 14) is transferred to bushing 22 by plunger shaft spring 28 which surrounds the plunger 26 and is trapped between an external shoulder on plunger 26 and the inner face of bushing 22. During a locking cycle, by transferring the movement of plunger 26 to locking lug bushing 22 via plunger shaft spring 28, the motor 23 is allowed to complete its preprogrammed number of revolutions, even though the outside door handle 14 may become bound. For example, a user may inadvertently or purposefully apply enough torque manually to the outside door handle 14 to cause such binding during operation of motor 23 to complete a locking cycle. Advantageously, if the handle locking lug 20 becomes bound during the locking cycle, the motor 23 operates to complete its cycle and potential energy is stored in the plunger shaft spring 28 to enable the plunger shaft spring 28 to complete the locking action once the locking lug 20 becomes unbound. Again, this binding problem occurs if torque is placed on the outside door handle or knob 14 before and/or during the locking of the lockset 11.

It is quite simple to prevent movement of the motor 23 within the rotatable handle sleeve of the motor actuated cylindrical lockset 11. The user must simply insert the motor 23 into the cavity of the cylindrical side wall of the motor housing 214. Then, the user presses the motor 23 through the cavity until the motor 23 engages the mounting tab 264 and the motor 23 assumes a self-contained pre-assembled position within the housing 214. Next, the user installs the motor housing 214 into the passageway 64 of the rotatable handle sleeve 58. Preferably, this installing step includes sliding the motor housing 214 into the inside handle sleeve 58 until the notch 246 is aligned with the locking tabs 216. Similarly, the gripping tab 332 assumes its fixed position once the housing 330 as been pressed into the handle sleeve 312 to the point that the tab 332 is aligned with the slot 320 and the tab 332 snaps therethrough.

Although the invention has been described in detail with reference to certain preferred embodiments, variations, and modifications exist within the scope and spirit of the invention as described and defined in the following claims.

What is claimed is:

1. A motor-mount apparatus comprising a motor-actuated cylindrical lockset including a motor and a rotatable handle sleeve, a motor housing positioned to lie within the handle sleeve and supporting motor, and a plate positioned to lie within the lockset, the plate having support formed to include an aperture extending therethrough and a locking tab reaching into the aperture, the locking tab being positioned to lie in the same plane as the support and formed for locking engagement with the motor housing to prevent both sliding axial movement of the motor housing through the aperture and rotation of the motor housing relative to the handle sleeve.

2. The apparatus of claim 1, wherein the handle sleeve includes a roll-back cam thereon, the support includes an inner surface and an opposite outer surface, and the aperture is sized for extension of the roll-back cam therethrough so that the roll-back cam rests upon the outer surface for guided rotation thereon.

3. The apparatus of claim 2, wherein the motor is formed to be positioned to lie within the motor housing and the motor includes a wire harness extending therefrom, and the apparatus further comprises means for retaining the wire harness on the outer surface of the support.

4. The apparatus of claim 1, wherein the motor housing includes an inner end and an opposite outer end, the outer end includes a notch defined by a bottom edge and opposite side edges, the bottom edge of the notch rests against the support of the plate, and the locking tab extends between the opposite side edges.

5. The apparatus of claim 4, wherein the plate includes two locking tabs positioned in spaced-apart relation to one another for engagement with the respective opposite side edges.

6. The apparatus of claim 4, further comprising a wire-protection cap mounted upon the plate, and wherein the motor has a wire harness extending therefrom and the locking tab includes a leg-receiving window positioned to lie adjacent the wire-protection cap and the window routes the wire harness therethrough so that the wire harness is routed from the motor housing, through the locking tab, and retained upon the plate by the wire-protection cap.

7. The apparatus of claim 1, wherein the plate includes means for blocking rotation of the locking tab relative to the rotatable handle sleeve.

8. The apparatus of claim 7, wherein the blocking means includes anchoring tabs that extend away from the support for attachment within the lockset.

9. A motor-mount apparatus comprising a motor-actuated cylindrical lockset having a rotatable handle sleeve and a motor, and a motor housing being formed for positioning within the handle sleeve, the motor housing having an inner end, an opposite outer end, means for preventing movement of the outer end relative to the handle sleeve, and a cylindrical side wall extending between the inner and outer ends, the cylindrical side wall including an inner surface defining a cavity sized for insertion of the motor therein.

10. The apparatus of claim 9, wherein the lockset includes a fixed hub surrounding the rotatable handle sleeve and having a notch formed therein and the preventing means is a gripping tab extending away from the outer end of the motor housing into the notch for frictional engagement with the fixed hub.

11. The apparatus of claim 10, wherein the fixed hub includes an outer end substantially aligned with the outer end of the motor housing, the lockset includes a plate mounted on the fixed hub at the outer end, and the gripping tab is sandwiched in the notch between the fixed hub and the plate to prevent sliding movement and rotation of the motor housing within the rotatable handle sleeve.

12. The apparatus of claim 10, wherein the motor includes a wire harness extending therefrom and the gripping tab is formed to include means for routing the wire harness through the fixed hub and away from the lockset.

13. The apparatus of claim 12, wherein the inner surface of the cylindrical side wall is formed to include an internal wire channel extending generally between the inner end and the routing means.

14. The apparatus of claim 12, wherein the gripping tab is formed to include a groove sized for receiving the wire harness therethrough so that the wire harness is routed from the motor housing, through the gripping tab, and away from the fixed hub.

15. The apparatus of claim 9, wherein the cylindrical side wall includes means for precluding sliding movement of the motor mount through the outer end of the motor housing.

16. The apparatus of claim 15, wherein the precluding means includes a mounting flange formed for locking engagement with the motor.

17. The apparatus of claim 16, wherein the motor housing includes a plurality of mounting flanges positioned about the circumference of the cylindrical side wall.

18. The apparatus of claim 9, wherein the motor housing includes means for obstructing rotation of the motor within the cavity of the cylindrical side wall.

19. The apparatus of claim 18, wherein the obstructing means includes a rim defining an aperture therethrough and the rim is formed for interlocking engagement with the motor.

20. The apparatus of claim 19, wherein the inner end includes a bottom wall and the aperture extends through the bottom wall.

21. A motor-mount apparatus for use with a motor actuated cylindrical lockset having a rotatable handle sleeve and a motor having a wire harness extending therefrom, the apparatus comprising a motor housing being adapted for positioning within the handle sleeve, the motor housing having an inner end, an opposite outer end, and a generally cylindrical side wall extending between the inner and outer ends, the cylindrical side wall including an inner surface defining a cavity and a notch formed at the outer end of the motor housing, the notch being defined by a bottom edge and opposite side edges, and a plate adapted to be coupled to the lockset in a generally stationary position, the plate being positioned to lie adjacent the outer end of the motor housing to cover the cavity and including a support having an aperture therethrough, the support engaging the bottom edge of the notch and the aperture receiving the opposite side edges to block sliding axial movement of the motor housing through the aperture.

22. A motor-mount apparatus for use with a motor-actuated cylindrical lockset including a rotatable handle sleeve and a motor including a wire harness extending therefrom, the apparatus comprising a motor housing adapted to lie within the rotatable handle sleeve, a plate having a support formed to include an inner surface, an opposite outer surface, an aperture extending therethrough, and a locking tab extending into the aperture, the locking tab being positioned to lie in generally the same plane as the support and being selectively coupled to the motor housing, and a wire-protection cap coupled to the plate, and adapted to retain the wire harness on the outer surface of the support.

23. The apparatus of claim 22, wherein the support of the plate is formed to include a pair of windows positioned in spaced-apart relation to one another and the wire-protection cap includes a body portion formed for engagement with the wire harness and leg portions extending from the body portion and through the windows for engagement with the inner surface of the support.

24. The apparatus of claim 22, wherein the plate includes two spaced-apart locking tabs.

25. The apparatus of claim 24, wherein the plate includes a lockset exit tab spaced-apart from the locking tabs.

26. The apparatus of claim 25, wherein the locking tabs define a first window therebetween and the lockset exit tab defines a second window therethrough.

27. The apparatus of claim 26, herein the wire-protection cap extends through the first and second windows and engages the plate.

28. The apparatus of claim 26, wherein the wire-protection cap includes a body portion and legs extending from the body portion and the legs extend through the first and second windows respectively and engage the plate to couple the wire-protection cap to the plate.

29. The apparatus of claim 24, wherein the wire-protection cap includes a body portion and legs extending from the body portion and the legs extend between the locking tabs and engage the plate to couple the wire-protection cap upon the plate.

30. The apparatus of claim 22, wherein the motor housing includes an outer wall formed to include a notch therein and the plate engages the notch.

31. The apparatus of claim 30, wherein the notch is defined by side walls and the locking tab extends into the notch between the side walls.

32. The apparatus of claim 30, wherein the motor housing is formed from a plastics material.

33. The apparatus of claim 22, wherein the motor includes a boss and the motor housing includes an inner end portion spaced-apart from the plate and the inner end portion is formed to include a notch sized to receive the boss therein.

34. A motor-mount apparatus comprising a motor-actuated cylindrical lockset including a rotatable handle sleeve having a roll-back cam thereon and a motor having a wire harness extending therefrom, a motor housing receiving the motor therein, a plate having a support formed to include an inner surface, an opposite outer surface, and an aperture extending between the inner and outer surfaces and receiving the roll-back cam therethrough, the outer surface supporting the roll-back cam for guided rotation thereon and a locking tab reaching into the aperture, the locking tab being positioned to lie in generally the same plane as the support coupled with the motor housing to prevent both sliding axial movement of the motor housing through the aperture and rotation of the motor housing relative to the handle sleeve, and a wire harness retainer positioned to retain the wire harness on the outer surface of the support.

35. The apparatus of claim 34, wherein the wire harness retainer includes a wire-protection cap coupled to the plate and the wire-protection cap includes a body portion having a wire channel extending away from the motor housing therein and the wire channel is adapted to route the wire harness away from the motor housing.

36. The apparatus of claim 35, wherein the wire-protection cap includes leg portions extending from the body portion and each leg portion of the wire-protection cap includes a tab thereon that engages the inner surface of the support.

37. The apparatus of claim 34, wherein the wire-harness retainer is coupled to the plate.

38. The apparatus of claim 37, wherein the wire harness retainer includes a body portion formed to include a wire channel therein to route the wire harness away from the motor housing and leg portions extending from the body portion and engaging the inner surface of the support.

39. The apparatus of claim 34, wherein the support of the plate is formed to include a pair of windows positioned in spaced-apart relation to one another and the wire harness retainer extends through the windows and engages the support.

40. The apparatus of claim 34, wherein the motor housing includes an inner end and an opposite outer end, the outer end includes a notch defined by a bottom edge and opposite side edges, the bottom edge of the notch rests against the support of the plate, and the locking tab extends between the opposite side edges.

41. The apparatus of claim 40, wherein the plate includes two locking tabs positioned in spaced-apart relation to one another and formed for engagement with the respective opposite side edges.

42. The apparatus of claim 34, wherein the plate includes anchoring tabs that extend away from the support and are coupled to the lockset.

43. A motor-mount apparatus comprising a motor-actuated cylindrical lockset having a rotatable handle sleeve and a motor, a motor housing positioned to lie within the handle sleeve, the motor housing having an inner end, an opposite outer end, and a side wall extending between the inner and outer ends, the side wall including an inner surface defining a cavity and a notch formed at the outer end of the motor housing, the notch being defined by a bottom edge and opposite side edges, and a plate coupled to the lockset in a generally stationary position, the plate being positioned to lie adjacent to the outer end of the motor housing and including a support having an aperture therethrough, the support engaging the bottom edge of the notch and the aperture receiving the opposite side edges to block sliding axial movement of the motor housing through the aperture.

44. The apparatus of claim 43, wherein the plate includes locking tabs reaching from the support into the aperture and the locking tabs are positioned to lie between the opposite side edges of the notch so that rotational movement of the outer end of the motor housing relative to the locking tabs is blocked.

45. The apparatus of claim 44, wherein the locking tabs engage the opposite side edges.

46. The apparatus of claim 44, wherein the locking tabs are positioned to lie in the same plane as the support.

47. The apparatus of claim 43, wherein the inner surface of the cylindrical side wall is formed to include an internal wire channel to route the wire harness through the outer end of the motor-housing.

48. The apparatus of claim 47, wherein the internal wire channel extends between the inner end and the bottom edge of the notch.

49. The apparatus of claim 48, wherein the support of the plate includes an inner surface engaging the bottom edge of the notch and an opposite outer surface and the aperture extends between the inner and outer surfaces and is sized for routing the wire harness therethrough.

50. The apparatus of claim 49, wherein the retaining means includes a wire-protection cap mounted on the outer surface of the support, the wire-protection cap including a body portion retaining the wire harness on the support and a leg portion extending from the body portion for mounting engagement with the inner surface of the support.

51. The apparatus of claim 43, wherein the inner end of the motor housing includes a notch therein and the motor includes a boss that extends into the notch.

52. The apparatus of claim 51, wherein the inner surface of the motor housing includes mounting flange that extends into the cavity and couples the motor in the cavity.

53. The apparatus of claim 52, wherein the mounting flange extends about a circumference of the inner wall.

54. The apparatus of claim 53, wherein the flange has a tapered surface.

55. The apparatus of claim 43, wherein the wire harness extends through the aperture and engages the support.

56. The apparatus of claim 55, wherein the plate includes two spaced-apart locking tabs and the wire harness extends between the locking tabs.

* * * * *